US008691403B2

(12) United States Patent
Amakusa et al.

(10) Patent No.: US 8,691,403 B2
(45) Date of Patent: Apr. 8, 2014

(54) METHOD FOR ANODIZING ALUMINUM AND ANODIZED ALUMINUM

(75) Inventors: Seiji Amakusa, Kasugai (JP); Tetsuyoshi Naito, Okazaki (JP); Norihiro Tateiwa, Chita-gun (JP); Takanobu Iwade, Okazaki (JP); Hiroshi Ohmi, Anjo (JP); Shinji Kurano, Chiryu (JP); Koichi Yokoyama, Nagoya (JP)

(73) Assignee: Denso Corporation, Kariya (JP)

( * ) Notice: Subject to any disclaimer, the term of this patent is extended or adjusted under 35 U.S.C. 154(b) by 417 days.

(21) Appl. No.: 12/655,142

(22) Filed: Dec. 23, 2009

(65) Prior Publication Data

US 2011/0203933 A1 Aug. 25, 2011

(30) Foreign Application Priority Data

Dec. 26, 2008 (JP) ..... 2008-335296
Apr. 10, 2009 (JP) ..... 2009-096227

(51) Int. Cl.
*G03C 1/54* (2006.01)

(52) U.S. Cl.
USPC ..... 428/846.4

(58) Field of Classification Search
USPC ..... 430/161, 655, 157, 165, 166; 428/846.4
See application file for complete search history.

(56) References Cited

U.S. PATENT DOCUMENTS 3,511,661 A * 5/1970 Deerhake et al. ..... 430/278.1
4,647,346 A * 3/1987 Miller et al. ..... 101/463.1
4,650,739 A * 3/1987 Simon et al. ..... 430/161
5,314,607 A 5/1994 Kaneko et al.
6,014,929 A * 1/2000 Teng ..... 101/456
6,099,953 A 8/2000 Komai et al.
6,322,689 B1 11/2001 Omasa
6,637,334 B2 * 10/2003 Akiyama et al. ..... 101/457
6,715,420 B2 * 4/2004 Blake et al. ..... 101/456
7,118,848 B2 * 10/2006 Hotta et al. ..... 430/302
7,201,850 B2 * 4/2007 Kawanishi et al. ..... 216/9

FOREIGN PATENT DOCUMENTS

JP 05-024377 2/1993
JP 05-032083 2/1993
JP 5-125597 5/1993
JP 05-195291 8/1993
JP 07-090688 4/1995
JP 08-337896 12/1996
JP 09-217200 8/1997

(Continued)

OTHER PUBLICATIONS

Office action dated May 10, 2011 in corresponding Japanese Application No. 2009-096227.

*Primary Examiner* — Cathy Lam
(74) *Attorney, Agent, or Firm* — Harness, Dickey & Pierce, PLC

(57) ABSTRACT

A method for anodizing aluminum, wherein an object (29) made of aluminum or an aluminum alloy is anodized in an electrolytic solution (25), and thereby an anodized aluminum film is formed on a surface of the object (29), is provided. The electrolytic solution (25) is comprised of at least one acid selected from organic acids having two or more carboxylic groups, moves at an average speed of 15 cm/sec or less along at least an outer surface of the object (29). The anodization is performed under conditions that a temperature of the outer surface of the object (29) is 80° C. or less, and current density is in a range from 10 to 170 A/dm$^2$.

2 Claims, 10 Drawing Sheets

(56) References Cited

FOREIGN PATENT DOCUMENTS

| | | |
|---|---|---|
| JP | 11-236696 | 8/1999 |
| JP | 2000-282293 | 10/2000 |
| JP | 2003-328187 | 11/2003 |
| JP | 2004-035930 | 2/2004 |
| JP | 2004-043873 | 2/2004 |
| JP | 2005-029891 | 2/2005 |
| JP | 2005-068458 | 3/2005 |
| JP | 2005-220436 | 8/2005 |
| JP | 2005-304197 | 10/2005 |
| JP | 2005-314751 | 11/2005 |
| JP | 2006-213992 | 8/2006 |
| JP | 2006-336050 | 12/2006 |
| JP | 2007-154300 | 6/2007 |
| JP | 2007-154301 | 6/2007 |
| JP | 2007-154302 | 6/2007 |
| JP | 2007-204831 | 8/2007 |
| WO | WO 97/35716 | 10/1997 |

* cited by examiner

METHOD FOR ANODIZING ALUMINUM AND ANODIZED ALUMINUM

TECHNICAL FIELD

The present invention relates to a method for anodizing aluminum wherein an object, to be treated, made of aluminum or an aluminum alloy is anodized in an electrolytic solution, to thereby form an anodized aluminum film. The present invention, in particular, relates to a method for manufacturing anodized aluminum using such an anodization method, and an anodized aluminum obtained by the method.

BACKGROUND ART

Recently, the demand for aluminum has been increasing in a wide range of industries, such as the home appliance industry and automotive industry, etc., since aluminum is lightweight, highly workable (high extensibility and forgeability), and has high thermal conductivity, etc. However, aluminum is soft, and is not suitable for practical use. Therefore, the surface of an article made of aluminum is generally anodized to form an anodic oxide film exhibiting good characteristics, such as hardness, corrosion resistance, abrasion resistance, adhesion, uniformity, and coloring, etc. The anodized aluminum film obtained is generally called "an alumite film".

As one method for forming an anodic oxide film on aluminum, electrolysis in an acidic bath or an alkaline bath is generally known. Among the known methods, a sulfuric acid bath is most popular, and a film obtained using the sulfuric acid bath has the advantages of high corrosion resistance, abrasion resistance and also low manufacturing cost. Other acidic baths such as an oxalic acid bath, chromic acid bath, and a phosphoric acid bath, etc., are known.

Anodized aluminum treatment is carried out as follows; an object, used as an anode, is supplied with electricity in an electrolytic solution comprising sulfuric acid or oxalic acid, etc.; consequently a surface of the object is oxidized, generating Joule heat according to the following reaction formula;

$$2Al^{3+}+3O^{-2}\rightarrow Al_2O_3(\text{anodized aluminum film})$$

and thus, an $Al_2O_3$ film (anodized aluminum film) is formed in the direction of depth. As shown in FIG. 1, the anodized aluminum film 2 formed on the object 1 expands in the volume at the treated surface 3, and grows upward and downward with respect to the untreated surface 4. Furthermore, as shown in FIG. 2, the film formed on the object 10 has a structure comprised of a porous layer 13 consisting of cells, each having a pore called a fine pore 11 and a cell diameter 12, and a barrier layer 14 under the porous layer.

Traditional anodization requires about one hour to form an anodized aluminum film of approximately 2.5 μm in thickness, for example, using a sulfuric acid bath, and has been strongly desired to be improved.

Japanese Unexamined Patent Publication No. 7-90688 discloses an attempt to shorten the anodization time to form an anodized aluminum film. In other words, Japanese Unexamined Patent Publication No. 7-90688 discloses a method of high-speed anodized aluminum treatment, wherein a surface of an object made of an aluminum alloy is subjected to a high-speed anodized aluminum treatment to form an oxide film thereon, characterized in that while an oxide film is formed on the surface of the member to be treated, the surface of the oxide film is flattened. However, in such an anodized aluminum treatment, it is necessary to provide in a cathode a portion to be treated in order to flatten the surface of the oxide film formed on the object, and accordingly there is a need of further improvement.

Japanese Unexamined Patent Publication No. 2005-304197 discloses a power supply device for anodization, which has a pair of pulse current generating circuits, and which variably controls positive and negative direct currents separately to supply high frequency pulses to a load circuit, so that an oxide film can be formed on an anode at a high speed and a high density. Japanese Unexamined Patent Publication No. 2007-154300 discloses a method for anodizing an aluminum alloy, characterized by short-circuiting an anode for anodization and a cathode for anodization when no pulse voltage is applied. Japanese Unexamined Patent Publication No. 2007-154301 discloses a method for anodizing an aluminum alloy characterized by performing anodization at a frequency corresponding to the lowest electrolytic voltage. Japanese Unexamined Patent Publication No. 2007-154302 discloses a power supply system for anodizing an aluminum alloy, comprising a condition input means, a control means which controls the pulse shape and pulse duty ratio according to a change of the electrolytic voltage or electrolytic current density in accordance with the progress of the anodization, and a power supply unit.

Japanese Unexamined Patent Publication No. 2004-35930 discloses a method of anodization of an aluminum alloy, wherein an aluminum or aluminum alloy object is immersed in a treatment bath, and is supplied with a high frequency current from 200 to 5000 Hz to anodize the aluminum or aluminum alloy. More specifically, this patent publication describes that, for example, the concentration of the sulfuric acid treatment bath is preferably from 3 to 30%, or an oxalic acid bath preferably from 1 to 5%, and the temperature of the treatment bath is preferably from −5 to 40° C. in case of a sulfuric acid bath or preferably from 10 to 60° C. in case of an oxalic acid bath.

Japanese Unexamined Patent Publication No. 2007-204831 discloses a method of a high-speed formation of an anodic oxide film of aluminum or an aluminum alloy having a thickness of 150 μm or more, wherein electrolysis is performed by applying an alternating current superimposed on a direct current, and time-dependent controlling the electrolytic current density. This patent publication specifically describes that the basic current density is in the range from 0.5 to 20 A/dm$^2$, and the amplitude is in the range from 0.5 to 15 A/dm$^2$, individually in the course of electrolysis, and the acidic bath is a sulfuric acid bath or an oxalic acid bath.

However, the methods of anodization described in Japanese Unexamined Patent Publication Nos. 2005-304197, 2007-154300, 2007-154301, 2007-154302, 2004-35930 and 2007-204831 have, for example, a drawback that a dedicated device e.g., a device variably controls positive and negative direct currents separately, or a device supplies a high frequency pulse current to a load circuit, must be provided.

Regarding the anodization of aluminum using an oxalic acid bath, WO97/35716 discloses a method for manufacturing a thermoplastic resin-coated aluminum alloy sheet, wherein an aluminum alloy sheet, as a substrate, is treated with an alkaline solution, followed by treatment with an acidic solution, so that a surface of the sheet has an increasing rate of 3 to 30%, of the specific surface area and then is subjected to anodization treatment, and further, a thermoplastic resin layer is laminated on at least one side of the substrate. In this method, the aluminum alloy sheet which has been subjected to the acid treatment is anodized using an acidic solution comprising, as a main component, one acid or two or more acids, selected from sulfuric acid, phosphoric acid, carboxylic acid and peroxycarboxylic acid, of 10 to 100 g/L under the conditions of a temperature from 30 to 80° C. and a current density from 2.5 to 50 A/dm$^2$. More specifically, describes that the thickness of the oxide film formed by the anodization is 2 to 10 nm, and the carboxylic acid is oxalic acid or acetic acid.

Japanese Unexamined Patent Publication No. 2003-328187 discloses a method for surface-treating an aluminum material to form an anodic oxide film on a surface of the aluminum material made of aluminum or an aluminum alloy, wherein anodization is performed in an electrolytic bath consisting of an oxalic solution at a final voltage from 100 to 550 V, and then heat treatment is performed at an ambient temperature from 100 to 300° C. for 15 to 300 minutes. Furthermore, it is also described that one or two or more factors selected from an oxalic acid concentration from 5 to 80 g/L in the electrolytic bath, a bath temperature from 0 to 15° C., and an electrolytic current density from 2 to 10 A/dm$^2$ are used in the anodization.

Japanese Unexamined Patent Publication No. 2005-29891 discloses a method for manufacturing a surface-treated aluminum material, comprising a step of anodizing an aluminum substrate made of aluminum or an aluminum alloy which is immersed in an electrolytic solution, and supplied with electricity, and a step of sealing the pores of the aluminum substrate using pressurized steam or high-temperature water of 95° C. or more, wherein the concentration of dissolved aluminum in the electrolytic solution is 0 to 5 g/L, and the electrolytic solution contains 10 to 50 g/L of any one acid or a mixture thereof selected from oxalic acid, malic acid, melonic acid, malonic acid, or tartaric acid, and the temperature of the electrolytic solution is 5 to 20° C.

However, in the methods of anodization using the oxalic acid solution as an electrolytic solution, as described in WO97/35716 and Japanese Unexamined Patent Publication Nos. 2003-328187 and 2005-29891, it is difficult to shorten the anodization time to form an anodized aluminum film of approximately 2.5 μm in thickness, and there is a need for further improvement.

Japanese Unexamined Patent Publication No. 5-24377 discloses a method for anodizing a support for a planographic printing plate, wherein an elongated aluminum or aluminum alloy strip is supplied with electricity, and anodized by electrodes provided in an electrolytic solution in which the strip is moved, and the electrolytic solution flows at a flow rate of at least 200 mm/second.

Japanese Unexamined Patent Publication No. 9-217200 discloses an anodizing device for aluminum or an aluminum alloy, having an anode circuit which is provided with a current distribution resistor, wherein the electrolytic solution is distributed at a uniform flow rate, and is uniformly injected from discharge slits of a rotary injector onto a surface of an object used as the anode.

Japanese Unexamined Patent Publication No. 11-236696 discloses a method of high-speed anodization of aluminum, wherein under control of the flow rate of the solution circulated and stirred in an electrolytic bath so that the flow rate relative to an object is regulated to be 30 cm/second or more, and 300 cm/second or less, a prescribed initial current density is controlled to be low to anodize the object.

Japanese Unexamined Patent Publication No. 2004-43873 discloses a method for surface treatment of an aluminum alloy, wherein while a circulation operation in which an electrolytic solution discharged from a discharge opening flows rotating around a member to be treated in an electrolytic tub, is then discharged therefrom, and is returned to the discharge opening is performed, the member to be treated is supplied with electricity and anodized.

Japanese Unexamined Patent Publication No. 2005-68458 discloses a method for anodizing an aluminum alloy wherein a hole slightly larger than the cross-section of an object is provide in an electrolytic tub; the object is inserted into the hole so that a treating portion of the object on which an anodic oxide film is to be formed is located in the electrolytic tub, whereby a gap is formed between the hole and the object at the boundary between the treating portion and the remaining portion of the object; air is blown through an opening provided on the outside of the electrolytic tub from all directions of the outer circumference of the member, onto the boundary of the member to remove the electrolytic solution discharged through the gap from the electrolytic tub.

Japanese Unexamined Patent Publication No. 2005-314751 discloses an anodizing device having a sealing member to close an opening of a hollow part of an object to be treated, and an electrode placed in the hollow part, wherein the electrode is made of a hollow body and has an outlet of an electrolytic solution which extends from a hollow chamber of the electrode toward the inner part in a direction oblique to the tangential direction.

Japanese Unexamined Patent Publication No. 2006-336050 discloses an anodizing device having a first electrode which energizes a metallic object to be treated with a ring-shaped recess on the circumferential face, a second electrode having an electrolytic solution passage, an inner circumference surrounding the outer circumference of the object, and an outlet opposed to the recess and formed in the inner circumference to communicate with the electrolytic solution passage, an electrolytic solution supply means for supplying the electrolytic solution passage to the electrolytic solution and for spraying the electrolytic solution through the outlet toward the recess, and an energizing means for applying a voltage to the first electrode and the second electrode.

However, in the methods described in Japanese Unexamined Patent Publication Nos. 5-24377, 9-217200, 11-236696, 2004-43873, 2005-68458, 2005-314751 and 2006-336050, it is necessary to provide a high-speed liquid flow or a nozzle for a uniform liquid flow, etc, and consequently the apparatus is too complicated for treatment using a simple tub, and therefore further improvement is necessary.

Generally, in order to speed-up the anodized aluminum treatment, it is necessary to increase the current density. Because the increase of the current density increases a surface temperature of an object, it is common to lower the surface temperature of the object by enhancing the stirring or aeration of liquid, etc. However, it is difficult to uniformly cool a surface of an article having a complicated shape by flow of or aeration of liquid, etc. In particular, an oxalic acid bath which generates a large amount of heat creates irregular surface temperatures. Consequently, the thickness of the anodized aluminum film becomes thick at a high-temperature part and thin at a cooled part, thus leading to irregular thicknesses. In an extreme case, the film opposite, of the liquid flow is increased and burned due to overheating.

SUMMARY OF INVENTIONS

The formation speed of an anodized aluminum film is represented by the following formula:

$$\text{Film thickness}(\mu m) = K(\text{film formation coefficient}) \times \text{current density}(A/dm^2) \times \text{electrolyzation time}(min)$$

The use of an electrolytic solution with a high film formation coefficient and the increase of the current density are considered theoretically effective to accelerate the film formation, but may result in deterioration of the surface roughness. Therefore, it is necessary to find an optimal solution.

In view of the problems of the prior art, the present invention, in particular, provides a method of anodization for forming an anodized aluminum film of approximately 2.5 μm in thickness having a desired surface roughness and hardness wherein the anodization time is dramatically shortened.

Regarding the above problems, it is assumed that, for example, an electric current tends to not flow smoothly at a portion of an aluminum alloy that contains a large amount of Si, so that when the current density is low, the formed anodized aluminum film makes a resistance to a current, and consequently, the electric current flows into a portion wherein the anodized aluminum film is thin whereby the film thickness becomes relatively uniform, but the film thickness increases locally when the density current is high. This tendency is considered to be remarkable in a sulfuric acid bath with a high formation speed of an anodized aluminum film. It is expected that if an oxalic acid bath with a low formation speed of an anodized aluminum film is used instead of such a sulfuric acid bath, a reaction is accelerated in the film portion whose thickness is thin to form a film of a relatively uniform film thickness, when a resistant value of the formed anodized aluminum film is high. Under these circumstances, the inventors of the present invention have earnestly studied anodization using an oxalic acid bath, which is weak acid with a low aluminum dissolution rate and a low anodized aluminum film formation speed, instead of a sulfuric acid bath which is a strong acid which highly dissolves aluminum, etc., and a high anodized aluminum film formation speed, in order to restrict an increase of surface roughness due to Si in an aluminum alloy, which prevents the formation of an anodized aluminum film and tends to make the anodized aluminum film thickness nonuniform. It has been found that the anodization time can be dramatically shortened while restricting an increase of the surface roughness by decreasing the flow of an electrolytic solution around an object during the anodization, and the present invention has been completed based on this finding.

According to a first aspect of the present invention, there is provided a method for anodizing aluminum in which an object 29 made of aluminum or an aluminum alloy is anodized in an electrolytic solution (25) to form an anodized aluminum film on a surface of the object (29), wherein the electrolytic solution (25) contains at least one acid selected from organic acids having two or more carboxylic groups, and moves at least at the outer surface side of the object (29) at an average speed of not more than 15 cm/sec, and the anodization is performed under conditions that the outer surface temperature of the object (29) is not more than 80° C., and the current density is in the range of 10 to 170 A/dm$^2$.

With the aluminum anodizing method according to the first aspect, during the anodized aluminum treatment, since the average speed of the electrolytic solution flowing around the object is at least 15 cm/sec or less, which is extremely slow, the irregularity of the internal temperature of the object 29, whose surface temperature rises along with the anodization, can be reduced, thus leading to a uniform film thickness. Moreover, anodization time necessary to form an anodized aluminum film having a desired thickness, surface roughness and hardness can be dramatically shortened, compared with the anodization time in the prior art. For example, the time necessary to form an anodized aluminum film having a uniform thickness of approximately 2.5 μm can be shortened to approximately 16 seconds, at the shortest.

As shown in FIG. 3, the average speed (cm/sec) of the electrolytic solution 25 moving at least on the outer surface side of the object 29 means an average speed (cm/sec) of the electrolytic solution 25 moving in the vicinity of the outer surface of the object 2, and specifically, for example, when the electrolytic solution 25 moves from the bottom toward the top of the anodized aluminum treatment tub 20, the average speed is generally obtained by dividing the flow rate (cm$^3$/sec) of the electrolytic solution by the total cross-sectional area (cm$^2$) in the horizontal direction of an area (flow path) wherein the electrolytic solution rises in the anodized aluminum treatment tub.

The phrase "at least on the outer surface side of the object 29" means that, for example, if the object 29 has a cylindrical shape, the average speed of the electrolytic solution 25 can be, if necessary, 15 cm/sec or less not only at the outer surface side but also at the inner surface side of the object 29.

In the aluminum anodizing method according to the first aspect, if the average moving speed of the electrolytic solution on the outer surface side of the object is higher than 15 cm/sec, there is a undesired difference in the surface temperature between the portion of the object that is directly exposed to the solution flow and the portion that is not directly exposed to the solution flow. Consequently, the film thickness becomes thin at the portion that is directly exposed to the solution flow, and thick at the portion that is not directly exposed to the solution flow, wherein an undesirable burn occurs in an extreme case.

In the aluminum anodizing method according to the first aspect, if the outer surface temperature of the object (29) undesirably exceeds 80° C., the surface hardness, etc., is decreased.

Furthermore, in the aluminum anodizing method according to the first aspect, if the current density is less than 10 A/dm$^2$, the progress of anodization is too slow to significantly shorten the time for anodization. The current density more than 170 A/dm$^2$, is not desirable, since a very large amount of Joule heat is generated during anodization, so that the electrolytic solution on the surface of the object tends to boil.

An organic acid having two or more carboxyl groups is exemplified by oxalic acid, malonic acid, succinic acid, glutaric acid, maleic acid, itaconic acid, malic acid, tartaric acid, or citric acid, etc.

According to a second aspect of the present invention, there is provided a method for manufacturing an anodized aluminum, wherein an object (29) made of aluminum or an aluminum alloy is anodized in an electrolytic solution (25), to form an anodized aluminum film with 0.5 to 5 μm in thickness, not more than 2.4 μm in surface roughness, and 250 Hv or more in Vickers hardness, on a surface of the object (29), and wherein the electrolytic solution (25) contains at least one acid selected from organic acids having two or more carboxylic groups, and moves at least at the outer surface side of the object (29) at an average speed of not more than 15 cm/sec, and the anodization is performed under conditions that the outer surface temperature of the object (29) is not more than 80° C., and the current density is in the range of 10 to 170 A/dm$^2$.

With the method for manufacturing an anodized aluminum according to the second aspect, it is possible to shorten the anodization time necessary to form an anodized aluminum film having a desired thickness, surface roughness and hardness, compared With of the anodization time in the prior art, and it is also possible to make the film thickness uniform.

According to a third aspect of the present invention, there is provided anodized aluminum wherein the object (29) made of aluminum or aluminum alloy is anodized in an electrolytic solution (25) containing one acid selected from organic acids with two or more carboxylic groups under conditions that the electrolytic solution moves at least at the outer surface side of the object (29) at an average speed of not more than 15 cm/sec, and the outer surface temperature of the object (29) is 80° C. or less and the current density is in the range of 10 to 170 A/dm$^2$, to form an anodized aluminum film on the object, and wherein the film is 0.5 to 5 μm in thickness, 2.4 μm or less in surface roughness, and 250 Hv or more in Vickers hardness.

In the third aspect, it is possible to efficiently provide anodized aluminum with an anodized aluminum film having a desired thickness, surface roughness and hardness, and having a uniform thickness, formed by the anodization which results in dramatically shortened anodization time, compared with the conventional anodization.

In the anodized aluminum manufacturing method according to the second aspect, and an anodized aluminum according to the third aspect, if the thickness of the anodized aluminum film is less than 0.5 μm, or more than 5 μm, the advantageous effect expected from the invention may not be obtained. If the surface roughness exceeds 2.4 μm, or the Vickers hardness is less than 250 Hv, the obtained anodized aluminum cannot achieve the object of the invention.

DETAILED DESCRIPTION

In the preferred embodiment of an aluminum anodizing method according to the first aspect, an electrolytic solution 25 moves in a direction opposite to gravity to thereby accelerate separation and upward movement of an oxygen gas generated during the anodization from a surface of an object 29. In such an aluminum anodizing method, the rising of oxygen gas bubbles generated in the course of anodization is accelerated by the rising flow of the electrolytic solution, and the oxygen gas is eliminated more smoothly. Consequently, the interference in the flow of an electric current into the object is reduced, thus resulting in a uniform speed-up of the anodization. The heat generated by the anodization raises the outer surface temperature of the object 29. To this end, it is preferable that the heated electrolytic solution overflows out of an anodized aluminum treatment tub 20, so that a not-heated electrolytic solution constantly flows in through a lower part of the tub. The movement of the electrolytic solution 25 in a direction opposite to the gravity may be provided by natural convection.

In another preferred embodiment of an aluminum anodizing method according to the first aspect, the average moving speed of the electrolytic solution on the outer surface side of the object 29 is 10 cm/sec or less. With this anodizing method, the irregularity of the surface temperature of the object can be more certainly reduced. In order to make continuous anodization possible, it is preferable that a solution flow, i.e., an average moving speed of the electrolytic solution, be decreased during the anodization, and that the flow rate be increased when the object is replaced, so that the surface temperature of the object 29 which has been raised during the anodization can be easily decreased to a desired temperature. The average moving speed of the electrolytic solution on the outer surface side of the object 29 is, most preferably, 5 cm/sec or less.

Figure 8:
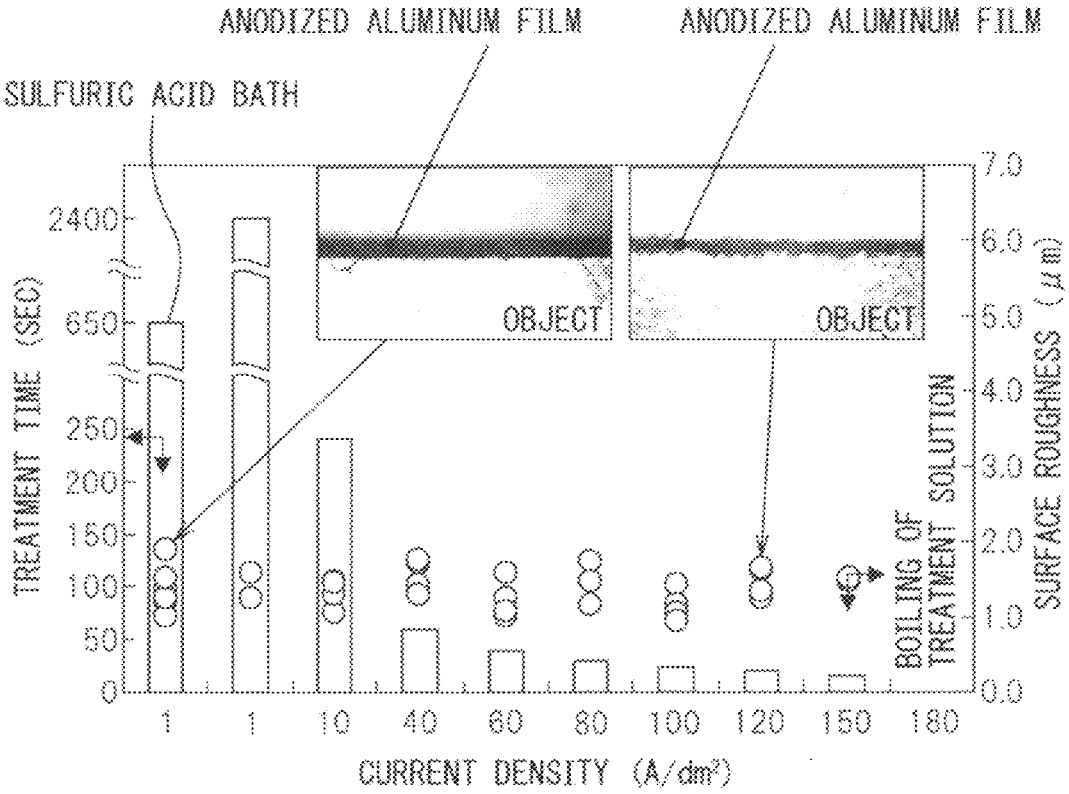
FIG. 8 shows the influence of the current density on the anodization time and a surface roughness of an anodized aluminum film in the examples, etc., of the present invention.

In another preferred embodiment of the aluminum anodizing method according to the first aspect, the current density is in the range of 40 to 170 A/dm$^2$. In the anodizing method according to the first aspect, the current density is in the range of 10 to 170 A/dm$^2$, more preferably, 40 to 170 A/dm$^2$, most preferably, 40 to 120 A/dm$^2$. In practice, the anodization is performed at a constant current density selected within, the range. The time for the anodization, as shown in FIG. 8, can be more remarkably shortened by maintaining the current density in the above range higher than the prior art range, in particular, in the range of 40 to 170 A/dm$^2$.

In another-preferred embodiment of the aluminum anodizing method according to the first aspect, the concentration of at least on acid selected from organic acids with two or more carboxylic groups contained in the electrolytic solution 25 is 20 to 120 g/L, in total. In other words, the concentration of at least one acid selected from organic acids having two or more carboxylic groups, such as oxalic acid, malonic acid, succinic acid, glutaric acid, maleic acid, itaconic acid, malic acid, tartaric acid, and citric acid, etc., is preferably 20 to 120 g/L, and most preferably 20 to 60 g/L when the acid is used solely. When two or more acids are used in combination, the total amount of the concentrations is, preferably, 20 to 120 g/L, and most preferably, 20 to 60 g/L. The use of at least one acid selected from organic acids with two or more carboxylic groups having the concentration as specified above makes the thickness of the formed film uniform, and makes it possible to prevent deterioration of the surface roughness after the anodization. If oxalic acid is used at a high concentration, due to a low water-solubility thereof, a crystal thereof tends to be precipitated at a portion on which the treatment solution remains, when the temperature of the treatment tub is decreased. Furthermore, the increase of the concentration of oxalic acid undesirably increases load on a wastewater treatment and therefore, the concentration is, most preferably, 20 to 60 g/L.

In another preferred embodiment of the method for anodizing aluminum according to the first aspect, the electrolytic solution 25 further contains at least one acid selected from nitric acid not more than 0.02 g/L, hydrochloric acid not more than 0.02 g/L, and sulfuric acid not more than 0.003 g/L. In other words, nitric acid in the range of 0 to 0.02 g/L, preferably, 0 to 0.002 g/L, hydrochloric acid in the range of 0 to 0.02 g/L, preferably, 0 to 0.002 g/L, and sulfuric acid in the range of 0 to 0.003 g/L, preferably, 0 to 0.001 g/L may be contained in the electrolytic solution. It is preferable that no nitric acid, hydrochloric acid and sulfuric acid be contained, but, in some cases, there is no problem caused by the presence of these acids in the electrolytic solution at the concentrations described above.

In another preferred embodiment of the aluminum anodizing method according to the first aspect, the acid contained in the electrolytic solution 25 is oxalic acid. In the aluminum anodizing method according to the first aspect, it is possible to use, as an acid to be contained in the electrolytic solution, at least one acid selected from organic acids with two or more carboxylic groups. In order to suppress an increase of the surface roughness of an anodized aluminum film which tends to occur when the forming speed of the anodized aluminum film by the anodization increases, the preferable organic acid with two or more carboxylic groups can be exemplified oxalic acid, malonic acid, succinic acid, glutaric acid, maleic acid, itaconic acid, malic acid, tartaric acid, and citric acid, etc., and specifically oxalic acid, which has a simple molecular structure, is superior in terms of the wastewater treatment.

In another preferred embodiment of the aluminum anodizing method according to the first aspect, the temperature of the outer surface of the object 29 is in the range of 3 to 80° C., more preferably, 3 to 70° C., and most preferably, 5 to 70° C. Maintaining anodization temperature in a relatively low value makes it possible to shorten the anodization time while more stably holding the anodized aluminum film formed by the anodization to thereby prevent an increase of the surface roughness.

The surface temperature of the object 29 rises along with the anodization. It is possible to reduce the irregularity of the internal temperature of the object 29, in order to make uniform the film thickness, by extremely reducing a flow of an electrolytic solution around the object during the anodization. Due to heat generation at the surface of the object 29, the temperature of the electrolytic solution 25 around the object, as well as the surface temperature of the object, rise and therefore, it is preferable that a lower-temperature electrolytic solution be constantly introduced in the anodized aluminum treatment tub 20 through the bottom part thereof, so that the hot solution overflows out of the anodized aluminum treatment tub to thereby remove the hot electrolytic solution from an anodized aluminum treatment tub 20.

In another preferred embodiment of the aluminum anodizing method according to the first aspect, the outer surface temperature of the object 29 is variable according to the progress of the anodization. It is possible to more certainly prevent a reduction of the film hardness and a deterioration of the surface roughness, by optimally setting the outer surface temperature of the object 29 according to the progress of the anodization.

In another preferred embodiment of the aluminum anodizing method according to the first aspect, the outer surface temperature of the object 29 is 3 to 30° C. at the beginning of the anodization, and is 5 to 80° C. at the end of the anodization. It is possible to more easily prevent the deterioration of the film hardness and surface roughness, by optimally setting the outer surface temperature at the beginning of and at the end of the anodization according to the progress of the anodization. The temperature at the beginning is, more preferably, 5 to 30° C., and the temperature at the end is, more preferably, 10 to 70° C.

In another preferred embodiment of the aluminum anodizing method according to the first aspect, the object is an aluminum die-cast article comprising Si. In the case of an aluminum die-cast article comprising Si, it is difficult to make the film thickness uniform. It is possible to obtain a uniform film thickness to thereby more certainly suppress a deterioration of the surface roughness, by using this method.

While the increase of the current density using, as an acid contained in the electrolytic solution, at least one acid selected from organic acids with two or more carboxylic groups as mentioned above, increases the diameter of the cells of the formed anodized aluminum film, there is a tendency of making the pores in a surface layer part of the film large because of dissolution of the anodized aluminum film into the electrolytic solution due to heat generation. As mentioned above, it is possible to suppress the dissolution of the anodized aluminum film into the electrolytic solution and the enlargement of the pores in the surface layer part of the film, by extremely decreasing a flow of the electrolytic solution around the object, and maintaining the anodization temperature in a relatively low value.

The preferred embodiment of the aluminum anodizing method according to the first aspect mentioned above is properly applicable-to the method for manufacturing an anodized aluminum according to the second aspect, and an anodized aluminum according to the third aspect.

In a method for manufacturing an anodized aluminum of the second aspect and in an anodized aluminum of the third aspect, the thickness of the anodized aluminum film is 0.5 to 5 μm, but more preferably, the thickness is 1 to 4 μm, most preferably, 1.5 to 3.0 μm. The thickness of the anodized aluminum film may be measured by a method generally used, more specifically, a method for observing a cross section of the anodized aluminum film embedded in a resin by a microscope, wherein the cross section is polished.

Furthermore, the surface roughness of the anodized aluminum film is 2.4 μm or less. The surface roughness of the anodized aluminum film may be measured by a method generally used, more specifically, a method using a probe type roughness meter.

Furthermore, the Vickers hardness of the anodized aluminum film is 250 Hv or more. The Vickers hardness of the anodized aluminum film may be measured by a generally-used method or, more specifically, a method using a Vickers hardness meter or a micro hardness meter.

In the first to the third aspects, the aluminum alloy is not specifically limited. For example, Al—Si—Cu die cast alloy (ADC12 and ADC10), Al—Si—Mg die cast alloy (ADC3), and Al—Si die cast alloy (ADC1) are used. The object is not specifically limited, and can be for example, a cylindrical sleeve valve, a scroll compressor and the like. The most suitable object in the present invention is an aluminum die cast product comprising Si.

EXAMPLES

Hereinafter, the present invention will be described in detail with reference to examples, but is not limited there to.

Anodized Aluminum Treatment Device

Figure 1:
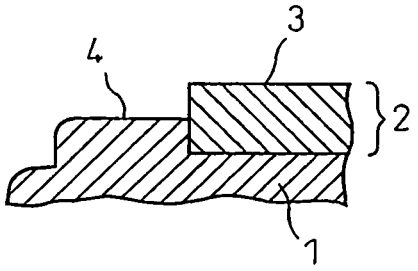
FIG. 1 schematically shows an anodized aluminum film formed by anodization.
Figure 2:
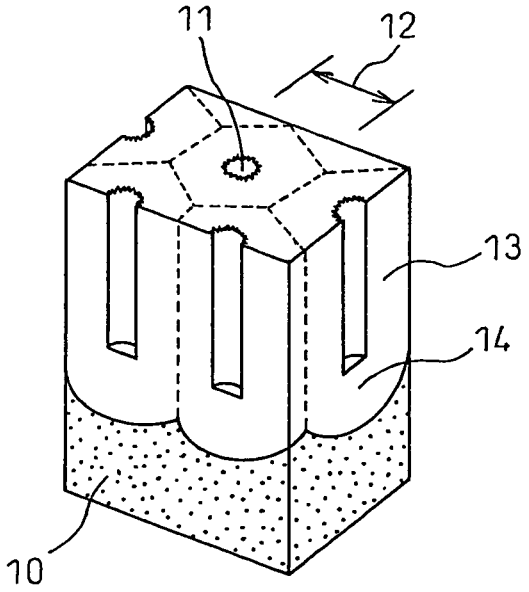
FIG. 2 schematically shows a structure of an anodized aluminum film formed by anodization.
Figure 3:
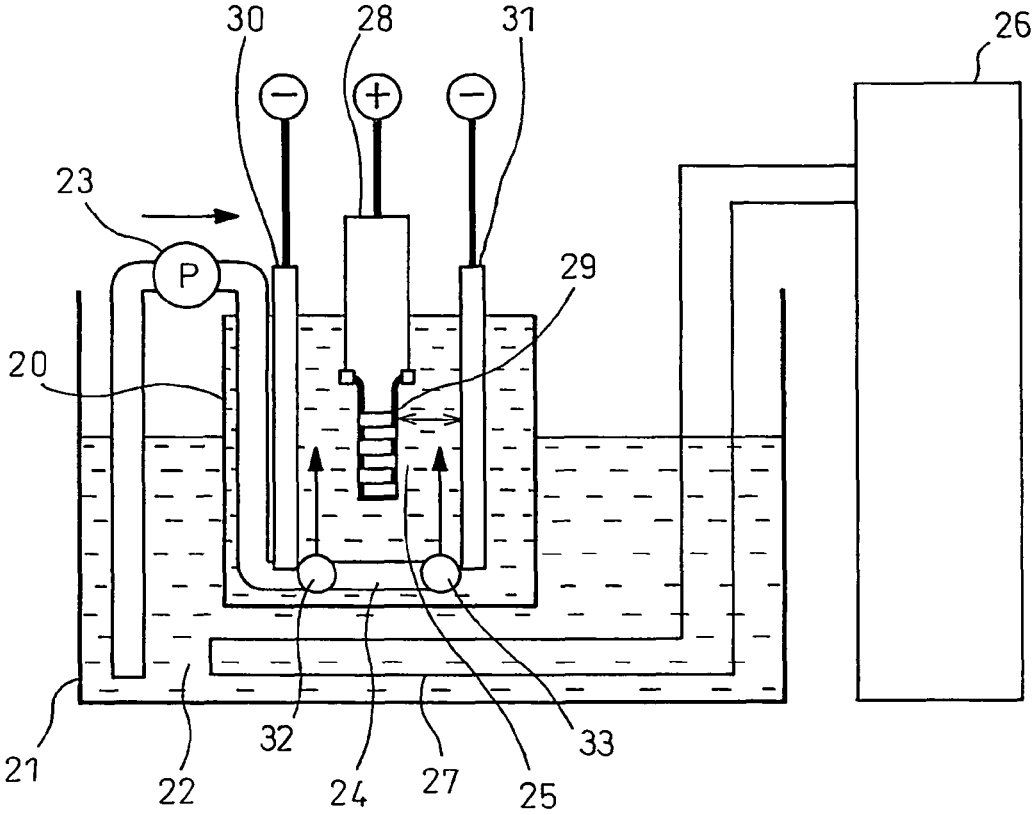
FIG. 3 schematically shows an anodizing device used in the example, etc., of the present invention.

The following examples, comparative examples and reference examples were obtained, using an anodized aluminum treatment device shown in FIG. 3. In the anodized aluminum treatment device shown in. FIG. 3, an anodized aluminum treatment tub 20 (the inner shape in a horizontal sectional view is rectangular; and the surface area of the inner horizontal section is 100 $cm^2$) is provided within a thermostatic bath 21 wherein an electrolytic solution 22 is pumped up at a desired flow rate (approximately 3 L/min, or less than 3 L/min, as necessary) by a pump 23, and ejected upward from the bottom part of the anodized aluminum tub 20 through openings 32, 33 of a pipe 24, and rises in the anodized aluminum tub 20 (the average rise speed of the electrolytic solution 25 on the outer surface side of the object 29 is approximately 0.5 cm/sec, or less than 0.5 cm/sec, as necessary), so that the electrolytic solution 25 in the anodized aluminum treatment tub 20 overflows from the upper part of the anodized aluminum treatment tub 20, and is returned to the thermostatic bath 21. The electrolytic solution 22 in the thermostatic bath 21 is cooled by a cooling pipe 27 connected with a temperature controller 26, and is maintained at a constant temperature. In the electrolytic solution 25 in the anodized aluminum treatment tub 20, the surface of the object 29 secured to the top of the anode is anodized between cathodes 30, 31 (for example, the distances between electrodes 28 and 30, and between electrodes 28 and 31 are approximately 50 mm, and a ratio between the area of the surface of each cathode 30 and 31, facing the object 29 and the outer surface area of the object 29 facing the cathodes is approximately 2, or more than 2, as necessary). A thermocouple (not shown) for measuring the outer surface temperature of the object 29 is provided on the outer surface of the object 29.

Method for Measuring Surface Roughness

A object having, for example, a cylindrical shape, of which a half at the end thereof is partially cut out so that the inside thereof can be seen, was used to measure the surface roughness in the present invention by a probe type roughness meter (model number SURFCOM480A, produced by Tokyo Seimitsu Co., Ltd.)

Method for Measuring Surface Hardness

Figure 4:
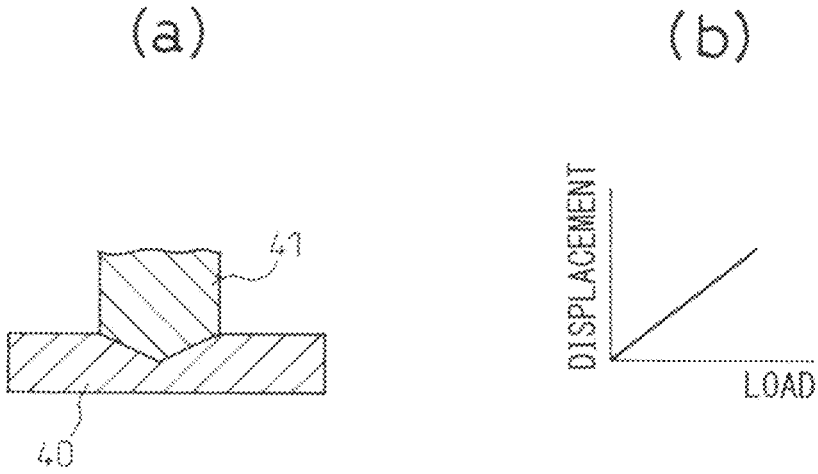
FIG. 4 schematically shows the measurement of a surface hardness of an anodized aluminum film using an ultrafine hardness meter used in the examples, etc., of the present invention.
Figure 5:
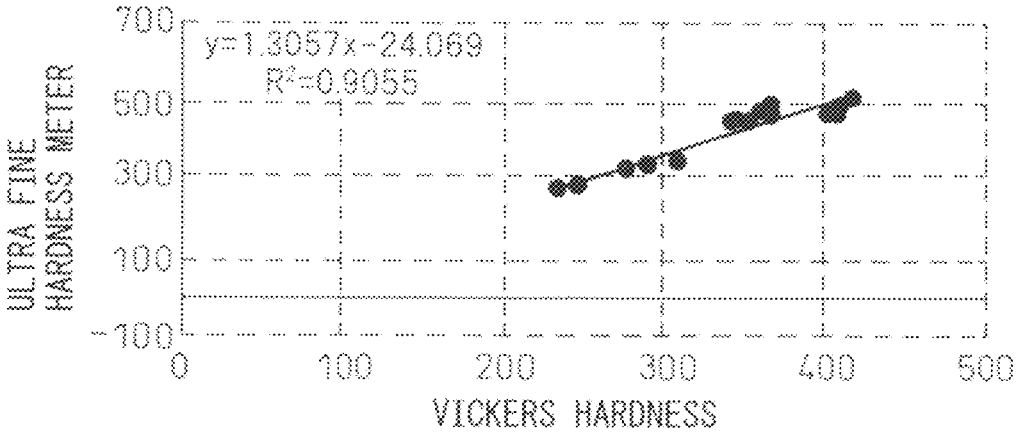
FIG. 5 shows a correlation between the hardness measured by an ultra fine hardness meter used in examples, etc., of the present invention and the Vickers hardness.

In the measurement of the surface hardness in the present invention, the thickness of the anodized aluminum film is approximately 2.5 μm, and accordingly, it is difficult to use a conventional Vickers hardness meter, since an indentation becomes lager than the thickness of the anodized aluminum film. Therefore, an ultra fine hardness meter (model No. DUH-W201S, produced by SHIMADZU), which can measure the hardness of the film with the thickness of 2.5 μm, was used. Because the ultra fine hardness meter and the Vickers hardness meter are different in the measurement principle and in the values to be obtained, various samples of anodized aluminum films 40 of the thickness of approximately 10 μm having different hardness were prepared. As shown in FIG. 4(*a*), values of Vickers hardness were calculated from the size of indentations (extension of the indentation) formed on the surfaces of the samples 40 when load 41 was applied. As shown in FIG. 4(*b*), a relation between the displacements of the surface caused by the indentations (depths of the indentations) formed on the surfaces of the samples 40 under load and the load was determined, whereby a correlation, as shown in FIG. 5, between the hardness measured by the ultra fine hardness meter and the Vickers hardness was obtained. The measured hardness was converted into Vickers hardness using the following correlation formula:

$$(\text{Hardness by the ultra fine hardness meter})=1.3057\times(\text{Vickers hardness})+24.069$$

Note that $R^2$=0.9055 shown in FIG. 5 means a good correlation.

Comparative Examples 1 to 5

Using the anodized aluminum treatment device shown in FIG. 3, an object 29 having a cylindrical shape (outer diameter was 18 mm; inner diameter was 9.5 mm; and length was 55 mm), made of an aluminum alloy comprising aluminum of 80.7 to 88.9% by weight and silica of 9.6 to 12.0% by weight, was anodized in an electrolytic solution containing sulfuric acid ($H_2SO_4$) at a concentration of 200 g/L and dissolved $Al^{3+}$ at a concentration of 3 to 4 g/L, at 15° C. of an initial temperature of the outer surface of the object of 29 (a terminal temperature of 80° C. or less) and at a current density of 0.3 A/$dm^2$ (comparative example 1), 1 A/$dm^2$ (comparative example 2), 2 A/$dm^2$ (comparative example 3), 10 A/$dm^2$ (comparative example 4), 20 A/$dm^2$ (comparative example 5). The flow rate of the solution fed by the pump 23 was 3 L/min (average rise speed of the electrolytic solution 25 on the outer surface side of the object 29 was approximately 0.5 cm/sec).

Figure 6:
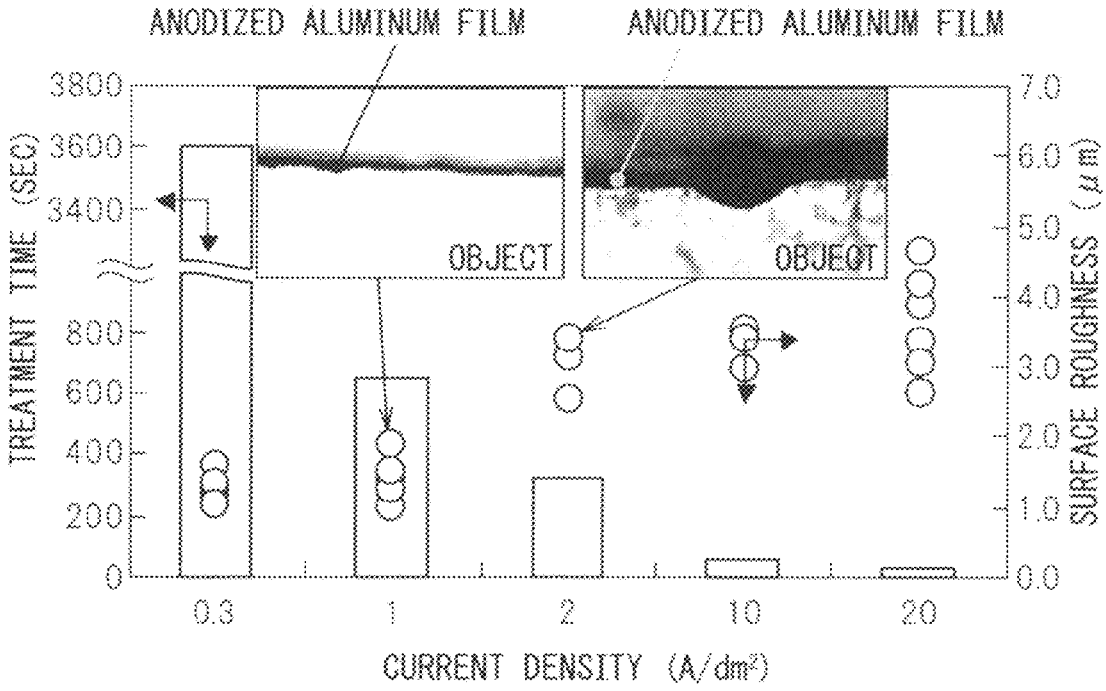
FIG. 6 shows the influence of the current density on the anodization time and a surface roughness of an anodized aluminum film, in comparative examples.

As a result, as shown in FIG. 6, to form the anodized aluminum film having a thickness of 2.5 μm, it took a treatment time of 3600 seconds at 0.3 A/$dm^2$ (Comparative Example 1), 650 seconds at 1 A/$dm^2$ (Comparative Example 2), 325 seconds at 2 A/$dm^2$ (Comparative Example 3), 60 seconds at 10 A/$dm^2$ (Comparative Example 4), and 30 seconds at 20 A/$dm^2$ (Comparative Example 5). The average values of surface roughness of each of the obtained anodized aluminum films, measured by the method mentioned above, were 3.0 μm in comparative example 3, 3.2 μm in comparative example 4, and 3.6 μm in comparative example 5. These values were high, but not preferable as the surface roughness of the anodized aluminum film. As shown in FIG. 6 which shows a photography (microphotography) of the anodized aluminum film at 1.0 A/$dm^2$ in a cross-section (comparative example 2), the anodized aluminum film was uniform in thickness, while the anodized aluminum film at 2 A/$dm^2$ (comparative example 3) shown in a cross-section photography (microphotography) was not uniform in thickness.

Reference Examples 1 to 6

Using the anodized aluminum treatment device shown in FIG. 3, an object 29 having a cylindrical shape (outer diameter was 18 mm; inner diameter was 9.5 mm; and length was 55 mm), made of an aluminum alloy comprising aluminum of 80.7 to 88.9% by weight and silica of 9.6 to 12.0% by weight, was anodized in an electrolytic solution containing oxalic acid ($(COOH)_2.2H_2O$)) at a concentration of 50 g/L (i.e., $(COOH)_2$ of 36 g/L) and dissolved $Al^{3+}$ at a concentration of 1 g/L or less, at an initial temperature of the outer surface of the object 29 of 26° C. (terminal temperature of 80° C. or less) and at a current density of 10 A/$dm^2$. The flow rate of the solution fed by the pump 23 was 0 L/min (average rise speed of the electrolytic solution 25 on the outer surface side of the object 29 was approximately 0 cm/sec) (Reference Example 1), 2 L/min (average rise speed of the electrolytic solution 25 was approximately 0.3 cm/sec) (Reference Example 2), 3 L/min (average rise speed of the electrolytic solution 25 was approximately 0.5 cm/sec) (Reference Example 3), 5 L/min (average rise speed of an electrolytic solution 25 was approximately 0.8 cm/sec) (Reference Example 4), and 10 L/min (average rise speed of the electrolytic solution 25 was approximately 1.7 cm/sec) (Reference Example 5).

Figure 7:
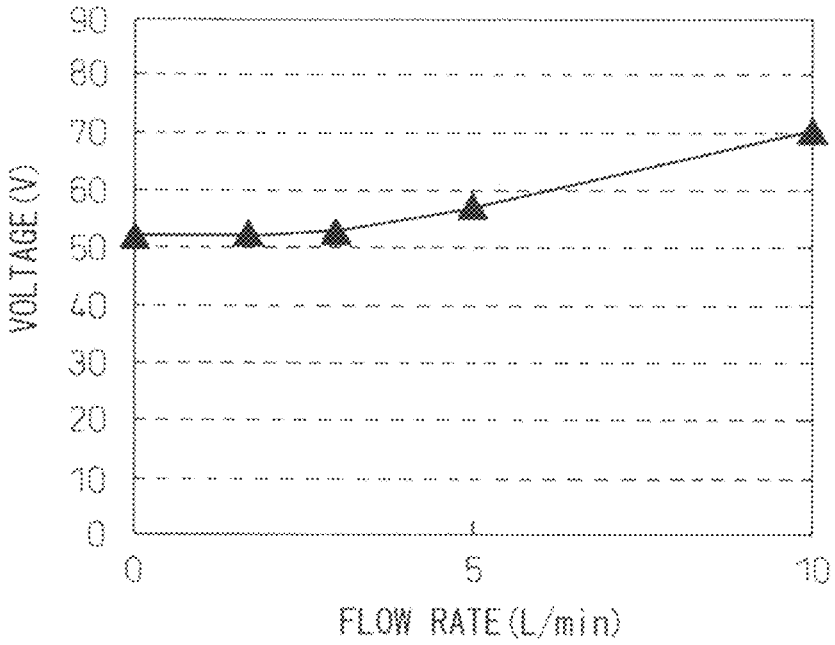
FIG. 7 shows the influence of the flow rate of the electrolytic solution on the whole voltage in anodization, in reference examples.

However, as shown in FIG. 7, a phenomenon occurs in that the entire voltage increased as the flow rate of the electrolytic solution 25 increased was observed. The reason for this tendency is believe to be due to the reaction resistance of the surface of the object 29 increases due to the increase of the rise speed of the electrolytic solution 25. On the basis of the result, it is preferable that the flow rate by the pump 23 be 3 L/min or less (i.e., the average rise speed of the electrolytic solution 25 on the outer surface side of the object 29 is approximately 0.5 cm/sec or less), to reduce the rise of the voltage.

In place of the arrangement shown in FIG. 3, in which the electrolytic solution is ejected upward from the two openings 32, 33 of the pipe 24, the anodization as mentioned above was performed using a system in which the electrolytic solution is ejected upward from a single opening of the pipe 24 located right below the object 29 (Reference example 6), and it was found that the whole voltage tends to increase. The reason for this tendency is believe to be due to the electrolytic solution 25 being directly impinged upon the object 29, so that the average rise speed of the electrolytic solution 25 on the outer surface side of the object 29 can be easily increased. On the basis of the result, it is understood that the system in which the electrolytic solution is ejected upward from the two openings 32, 33 of the pipe 24 as shown in FIG. 3, is more preferable than the system in which the electrolytic solution is ejected upward from the single opening of the pipe 24 located right below the object 29.

Examples 1 to 6 and Reference Examples 6 and 7

Using the anodized aluminum treatment device shown in FIG. 3, an object 29 having a cylindrical shape (outer diameter was 18 mm, inner diameter was 9.5 mm, and length was 55 mm), made of an aluminum alloy comprising aluminum of 80.7 to 88.9% by weight and silica of 9.6 to 12.0% by weight, was anodized in an electrolytic solution containing oxalic acid ($(COOH)_2.2H_2O$)) at a concentration of 50 g/L (i.e., $(COOH)_2$ of 36 g/L) and dissolved $Al^{3+}$ at a concentration of 1 g/L or less, at an initial temperature of the outer surface of the object 29 of 26° C. (an terminal temperature of 80° C. or less), at a flow rate of 3 L/min by a pump 23 (i.e., an average rise speed of the electrolytic solution 25 on the outer surface side of the object 29 was approximately 0.5 cm/sec) at a current density of 1 A/dm$^2$ (Comparative Example 6), 10 A/dm$^2$ (Comparative Example 7), 40 A/dm$^2$ (Example 1), 60 A/dm$^2$ (Example 2), 80 A/dm$^2$ (Example 3), 100 A/dm$^2$ (Example 4), 120 A/dm$^2$ (Example 5) and 150 A/dm$^2$ (Example 6).

In consequence, as shown in FIG. 8, the treatment times necessary to form an anodized aluminum film having a thickness of 2.5 μm and the average surface roughness of the obtained anodized aluminum film were respectively 60 seconds and 1.5 μm at 40 A/dm$^2$ (Example 1), 40 seconds and 1.2 μm at 60 A/dm$^2$ (Example 2), 30 seconds and 1.5 μm at 80 A/dm$^2$ (Example 3), 24 seconds and 1.2 μm at 100 A/dm$^2$ (Example 4), 20 seconds and 1.5 μm at 120 A/dm$^2$ (Example 5), and 16 seconds and 1.5 μm at 150 A/dm$^2$ (Example 6). The treatment times and the average surface roughness thereof were good. In contrast, as shown in FIG. 8, the treatment time necessary to form an anodized aluminum film having a thickness of 2.5 μm and the average surface roughness of the obtained anodized aluminum film were respectively 2400 seconds and 1.3 μm at 1 A/dm$^2$ (Comparative Example 6), and 240 seconds and 1.3 μm at 10 A/dm$^2$ (Comparative Example 7), and thus the treatments times thereof were long and improper. For reference, the result of Comparative example 2 ($H_2SO_4$, 1 A/dm$^2$) is also shown on the left side of FIG. 8.

In a cross-section photography (microphotography) of the anodized aluminum film at 120 A/dm$^2$ (Example 5) shown in FIG. 8, the anodized aluminum film is uniform in thickness as in Comparative example 2 ($H_2SO_4$, 1 A/dm$^2$). It was found that an increase of the surface roughness was suppressed moderately.

Figure 9:
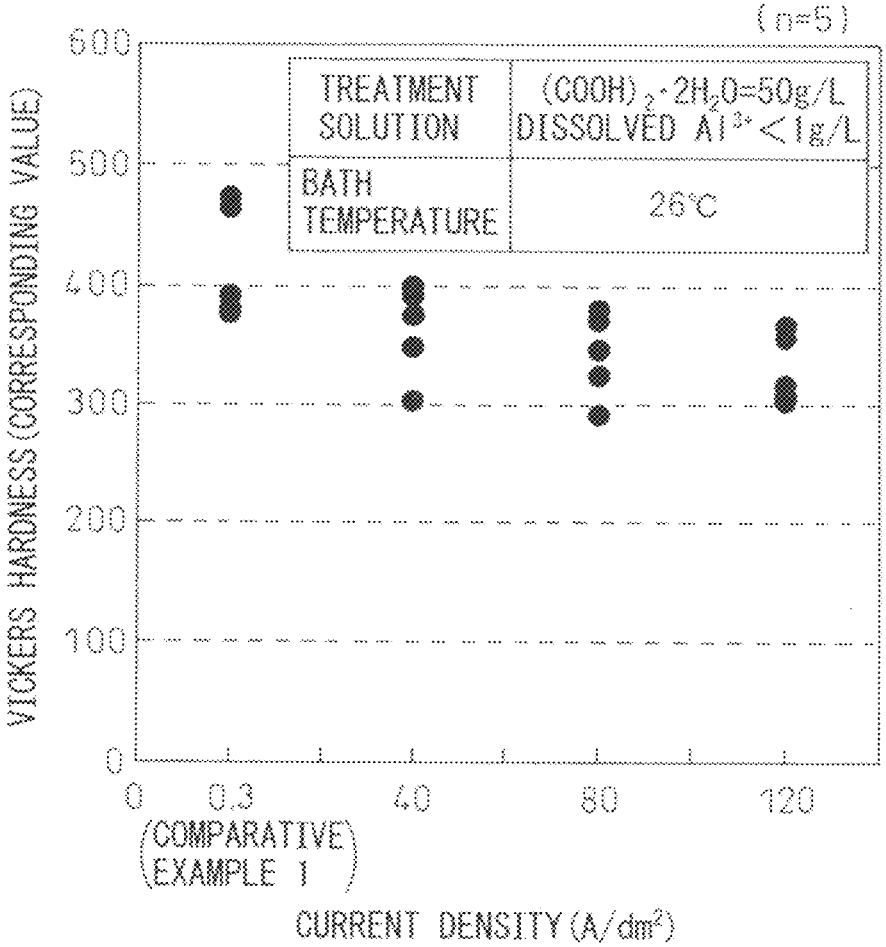
FIG. 9 shows the influence of the current density on the surface hardness of an anodized aluminum film in examples, etc., of the present invention.

FIG. 9 shows the Vickers hardness of the anodized aluminum films obtained at 40 A/dm$^2$ (Example 1), 80 A/dm$^2$ (Example 3), 120 A/dm$^2$ (Example 5), and 0.3 A/dm$^2$ (Reference Example 1). As shown in FIG. 9, the values of Vickers hardness of the anodized aluminum films obtained in Examples 1, 3 and 5 were in the range of 290 to 400, which was slightly lower than the range of 370 to 470, of the anodized aluminum film obtained in Comparative Example 1 (the treatment time of 3600 seconds), but the decreases of the surface hardness in the Examples 1, 3, and 5 were moderately suppressed.

Examples 7 to 17, Comparative Examples 8 to 11

Using the anodized aluminum treatment device shown in FIG. 3, an object 29 having a cylindrical shape (outer diameter was 18 mm, inner diameter was 9.5 mm, and length was 55 mm), made of an aluminum alloy comprising aluminum of 80.7 to 88.9% by weight and silica of 9.6 to 12.0% by weight, was anodized under the conditions shown in Table 1 below. The initial temperature of the outer surface of the object 29 was 18° C. (a terminal temperature of 80° C. or less), and the flow rate by the pump 23 was 3 L/min (average rise speed of the electrolytic solution 25 on the outer surface side of the object 29 was approximately 0.5 cm/sec).

TABLE 1

| Number | Oxalic Acid % by weight | Nitric Acid % by weight | Hydrochloric Acid % by weight | Sulfuric Acid % by weight | Current Density A/m$^2$ | Treatment Time Second |
|---|---|---|---|---|---|---|
| Example 7 | 5 | — | — | — | 54 | 30 |
| Example 8 | 5 | 0.03 | — | — | 54 | 30 |
| Example 9 | 5 | 0.06 | — | — | 54 | 30 |
| Example 10 | 5 | 0.10 | — | — | 54 | 30 |
| Comparative Example 8 | 5 | 0.3 | — | — | 54 | 30 |
| Example 11 | 5 | — | 0.005 | — | 54 | 30 |
| Example 12 | 5 | — | 0.01 | — | 54 | 30 |
| Example 13 | 5 | — | 0.04 | — | 54 | 30 |
| Example 14 | 5 | — | 0.09 | — | 54 | 30 |
| Example 15 | 5 | — | — | — | 54 | 30 |
| Example 16 | 5 | — | — | 0.005 | 58 | 30 |
| Example 17 | 5 | — | — | 0.01 | 58 | 30 |

TABLE 1-continued

| Number | Oxalic Acid % by weight | Nitric Acid % by weight | Hydrochloric Acid % by weight | Sulfuric Acid % by weight | Current Density $A/m^2$ | Treatment Time Second |
|---|---|---|---|---|---|---|
| Comparative Example 9 | 5 | — | — | 0.045 | 58 | 30 |
| Comparative Example 10 | 5 | — | — | 0.08 | 58 | 30 |
| Comparative Example 11 | 5 | — | — | 0.22 | 58 | 30 |

Figure 10:
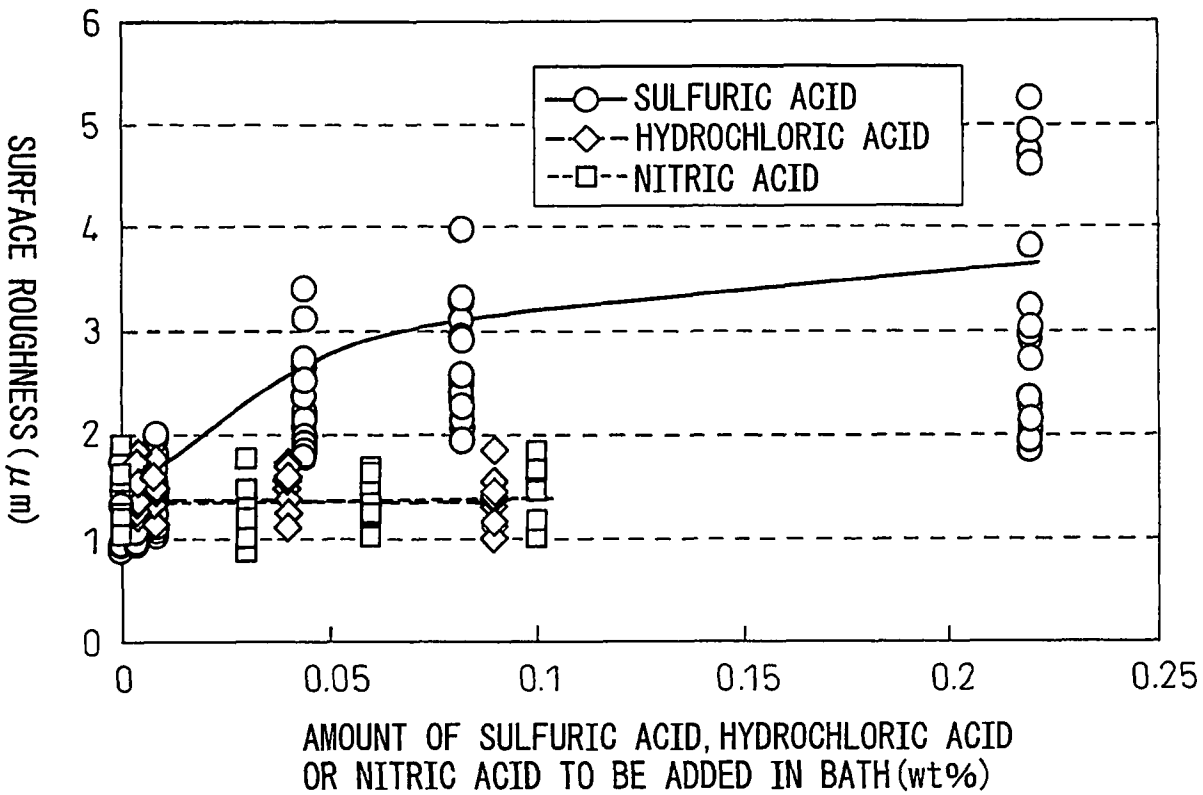
FIG. 10 shows the influence of the addition of nitric acid, hydrochloric acid or sulfuric acid on the surface roughness of an anodized aluminum film in examples, etc., of the present invention.

As shown in FIG. 10, a desired anodized aluminum having an anodized aluminum film of 1 to 4 μm in thickness and surface roughness of 2.4 μm or less was obtained in Examples 7 to 17. However, the thickness of the anodized aluminum film was less than 0.5 μm in Comparative Example 8, and the average surface roughness was more than 2.4 μm in Comparative Examples 9 to 11, and thus, no intended anodized aluminum was obtained.

Examples 18 to 20

Figure 11:
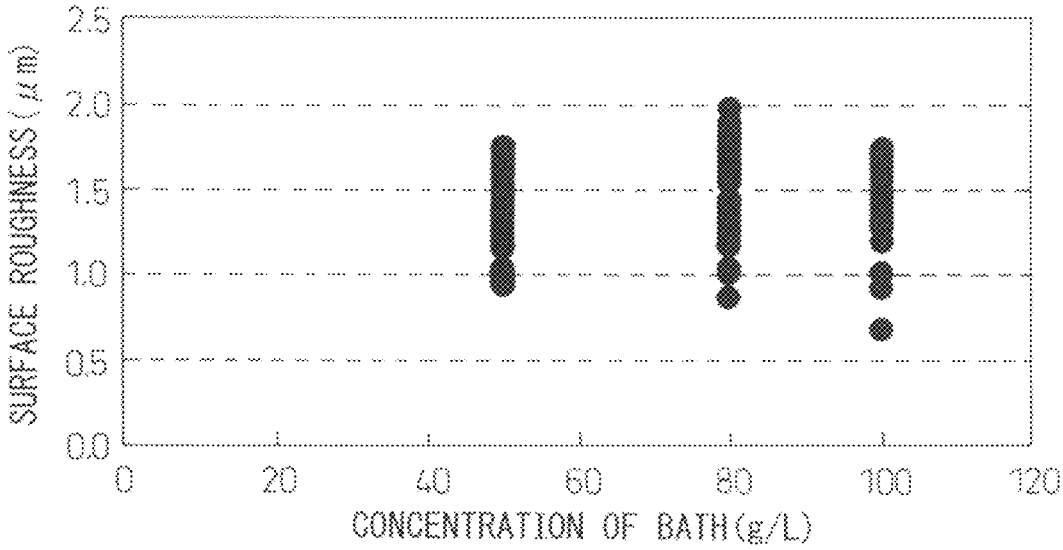
FIG. 11 shows the influence of the oxalic acid concentration in the electrolytic solution in the anodized aluminum treatment tub on the surface roughness in examples of the present invention.

Using the anodized aluminum treatment device shown in FIG. 3, anodization was performed under the same conditions as Example 7 mentioned above, except that the concentration of oxalic acid was 50 g/L (Example 18), 80 g/L (Example 19) and 100 g/L (Example 20). As shown in FIG. 11, it was found that there was no substantial difference in surface roughness among 50 g/L to 100 g/L in Examples 18 to 20.

Examples 21 to 23 and Comparative Example 12

Figure 12:
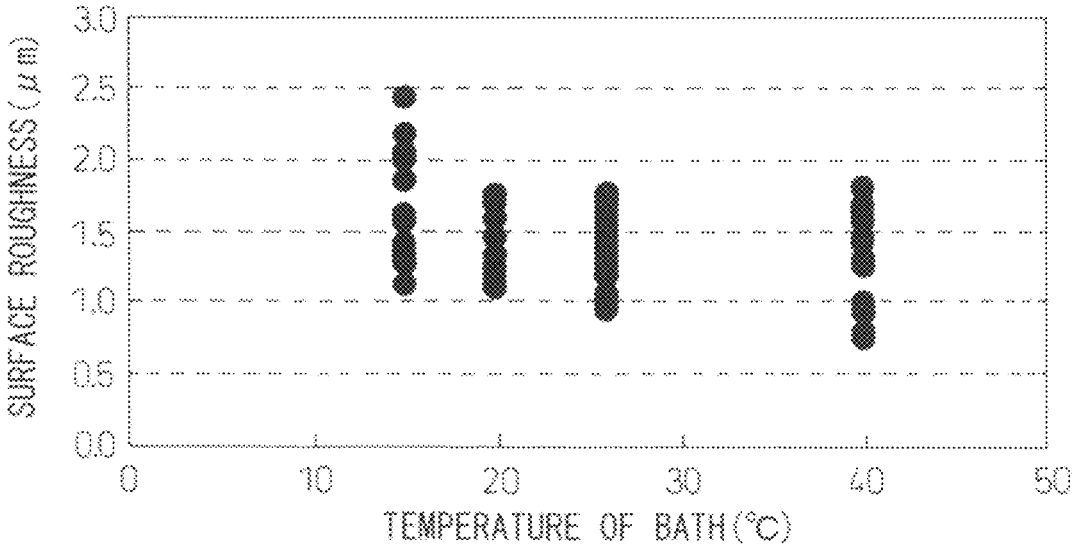
FIG. 12 shows the influence of the outer surface temperatures of the object on the surface roughness in examples of the present invention.

Using an anodized aluminum treatment device shown in FIG. 3, anodization was performed under the same conditions as Example 7 mentioned above, except that the initial temperature of the outer surface of the object 29 was 15° C. (a terminal temperature of approximately 45° C.) (Example 21), 20° C. (a terminal temperature of approximately 55° C.) (Example 22), 26° C. (a terminal temperature of approximately 70° C.) (Example 23), or 40° C. (a terminal temperature of approximately 90° C.) (Comparative Example 12). As shown in FIG. 12, when the initial temperature of the outer surface of the object 29 was lowered to 15° C., a slight tendency of irregular surface roughness was observed, but the irregularity is within in the acceptable range. However, in Comparative Example 12, in which the initial temperature of the object 29 was 40° C., the terminal temperature rose to approximately 90° C., and the surface hardness thereof was reduced.

Examples 24 to 26

Figure 13:
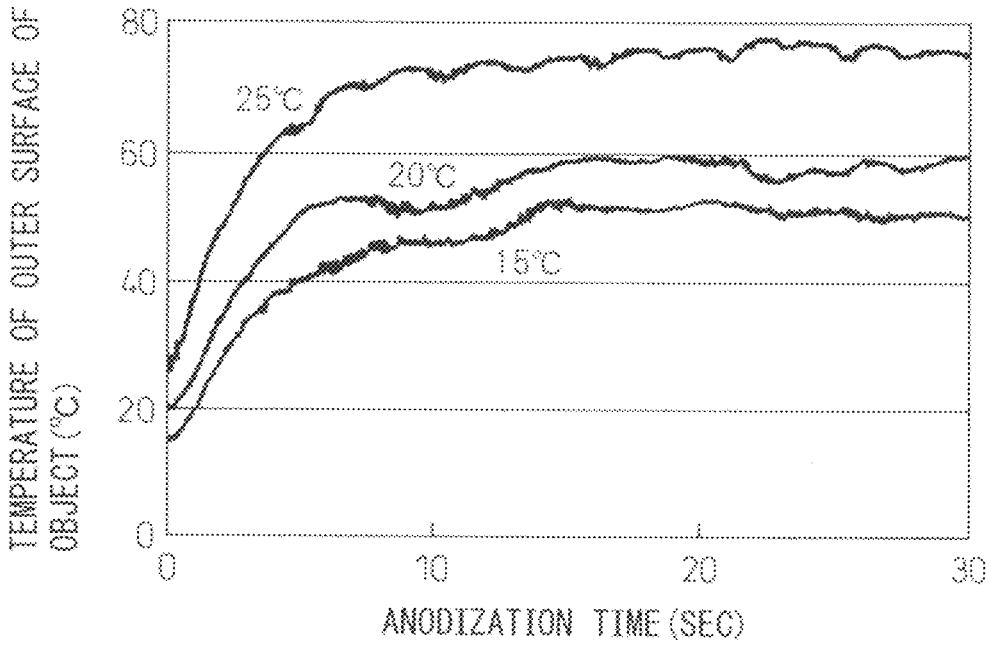
FIG. 13 shows a time-dependent change of the outer surface temperature of the object in examples of the present invention.

Using an anodized aluminum treatment device shown in FIG. 3, an object 29 having a cylindrical shape (outer diameter was 18 mm, inner diameter was 9.5 mm, and length was 55 mm), made of an aluminum alloy comprising aluminum of 80.7 to 88.9% by weight and silica of 9.6 to 12.0% by weight, was anodized in an electrolytic solution containing oxalic acid ($(COOH)_2.2H_2O$)) at a concentration of 50 g/L (i.e., $(COOH)_2$ of 36 g/L) and dissolved $Al^{3+}$ at a concentration of 1 g/L or less, under the conditions that the initial temperature of the outer surface of the object 29 was 15° C. (Example 24), 20° C. (Example 25) or 25° C. (Example 26), at a flow rate by the pump 23 of 3 L/min (an average rise speed of the electrolytic solution 25 on the outer surface side of the object 29 was approximately 0.5 cm/sec) and the current density of 80 $A/dm^2$, and a time-dependent change of the outer surface temperature of the object 29 was detected. As shown in FIG. 13, the terminal temperature of the outer surface of the object 29 was respectively approximately 50° C. in Example 24, approximately 60° C. in Example 25, or approximately 75° C. in Example 26, and anodized aluminum having an anodized aluminum film thicknesses of 1 to 4 μm and surface roughness of 2.4 μm or less were obtained.

We claim:

1. An anodized aluminum film on an object made of an aluminum alloy, which has been formed by anodizing the object in an electrolytic solution containing one acid selected from organic acids with two or more carboxylic groups, and 0.005% to 0.01% by weight of sulfuric acid under conditions that the electrolytic solution moves at least at an outer surface side of the object at an average speed of not more than 15 cm/sec, and an outer surface temperature of the object is not more than 80° C., and the current density is in the range of 10 to 170 $A/dm^2$, wherein the anodized aluminum film is 0.5 to 5 μm in thickness, not more than 2.4 μm in surface roughness, and not less than 250 Hv in Vickers hardness; and said aluminum alloy comprising aluminum of 80.7 to 88.9% by weight and silica of 9.6 to 12.0% by weight.

2. An aluminum alloy component, having the anodized aluminum film thereon, according to claim 1.

* * * * *